US005337471A

United States Patent [19]

Graney

[11] Patent Number: 5,337,471

[45] Date of Patent: Aug. 16, 1994

[54] METHOD OF CONSTRUCTING A SEAT FOR A WOODEN DECK

[76] Inventor: Francis X. Graney, 50 Vale St., Tewksbury, Mass. 01876

[21] Appl. No.: 64,204

[22] Filed: May 21, 1993

[51] Int. Cl.[5] ..... B23P 11/00

[52] U.S. Cl. ..... 29/432; 29/525.1; 297/217; 297/451; 52/8

[58] Field of Search ..... 29/432, 525.1, 897; 52/8, 9, 6, 7, 79.6, 188; 297/451, 243, 440, 15, 217, 463, 232; 182/82, 132

[56] References Cited

U.S. PATENT DOCUMENTS

| | | | |
|---|---|---|---|
| 855,817 | 6/1907 | Schoenecke | 297/443 |
| 1,618,803 | 2/1927 | Bokan | 297/443 |
| 4,193,229 | 3/1980 | Hartman | 52/9 |
| 4,285,542 | 8/1981 | Boisvert | 52/8 |
| 4,918,880 | 4/1990 | Carney | 52/8 |

*Primary Examiner*—Mark Rosenbaum
*Assistant Examiner*—David P. Bryant
*Attorney, Agent, or Firm*—Richard F. Benway

[57] ABSTRACT

A method for constructing a seat for a wooden deck. Right triangular metal braces are attached between the deck floor and respective risers. At the deck floor, the braces are attached to anchor brackets which are secured to a cross stringer beneath the deck floor boards. The risers are attached to the perimeter of the deck via side brackets. The braces attach directly to their respective risers. Planks are then attached to the top sides of the braces and across the risers to form the seat portion and back portion, respectively, of the deck seat.

1 Claim, 3 Drawing Sheets

METHOD OF CONSTRUCTING A SEAT FOR A WOODEN DECK

BACKGROUND OF THE INVENTION

This invention relates largely to decks affixed to homes or similar structures. They are in essence extensions of the interior living space. They may also be found on yard decks or along boat docks. Their popularity has soared recently.

Some decks are constructed high off the ground—others but a few feet or even inches off the ground. In any event, the perimeter must be enclosed to prevent people from stepping or backing off the edge and injuring themselves.

A popular railing has evolved which doubles as a seat for people to sit on while on the deck. The safety of such a railing is most important. If a person were to fall off the deck because the railing failed, especially while sitting on the seat, he or she would be severely injured, if not killed.

A proliferation of these railings has ignored safety. U.S. Pat. No. 4,285,542 is an example of a device for facilitating the building of such a railing. All the force or weight of an occupant of the seat is directed to the edge of the deck and in some cases a small portion of one board that forms at least one edge of the deck. Additionally, the bracket in that invention exposes too much steel for the wooden rustic appearance intended. Such a device is destined to early failure and severe injuries to its owner or guests.

SUMMARY

An important feature of the present invention is to direct forces on the railing or seat in from the edge of the deck down into the supporting timbers. With rare exceptions, deck flooring members are the thinnest members in the entire deck system. Floor boards are merely nailed on to the timbers below in a direction that provides minimal resistance to any load, static or dynamic.

The present invention provides a leg of a steel triangular member that attaches to each riser of the rail backing and holds the riser firmly against hundreds of pounds of tension. The leg in turn is bolted through the floor to a timber underneath the floor which thereafter distributes this force safely throughout the deck system.

Therefore, an object of the present invention is to provide new method and means of building a strong, safe railing in the form of a seat for a deck.

Another object of the present invention is to provide new method and means of building a strong, sturdy railing/seat arrangement that does not expose excessive amounts of steel to preserve the aesthetic appearance.

Another object of the present invention is to provide a kit with three components, in addition to the usual deck materials, which enables one to construct a rail around a deck and seat with lumber which is strong and safe.

DESCRIPTION OF THE PREFERRED EMBODIMENT

Figure 1:
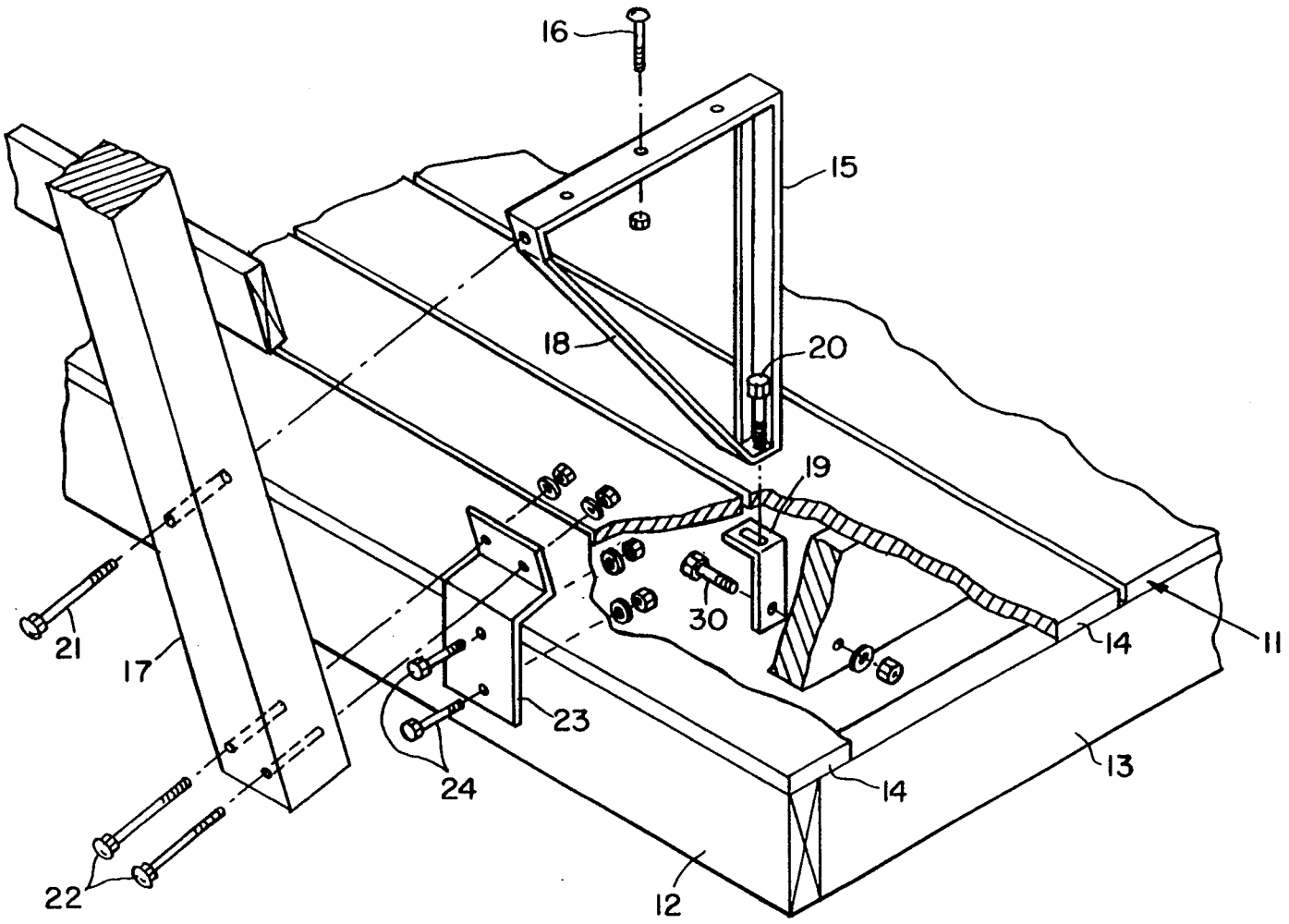
FIG. 1 is a blowup of the individual components needed in addition to the usual deck materials to construct a safe seat/deck rail.

Referring now to FIG. 1, the deck 13 is shown with its plank or decking boards 14, along the edge of the deck we have the first metal part 23 of the kit. It is bolted to the stringer 12 by bolt 24 that goes through the stringer and affixes to the understructure of the deck. Then, two bolts 22 affix the riser, which is also a railing 17 for the deck. Then a bolt 21 connects to a triangular seat support system 15 which has a cross member 18 connected to the understructure through a bolt 20 down to a member 19 which is bolted to a stringer by a bolt 30. The seat planks, which are the same as floor planks, are bolted on to the top of the triangular member by bolts 16. Additional planks are bolted to the railing 17 to form the back of the seat.

Figure 2:
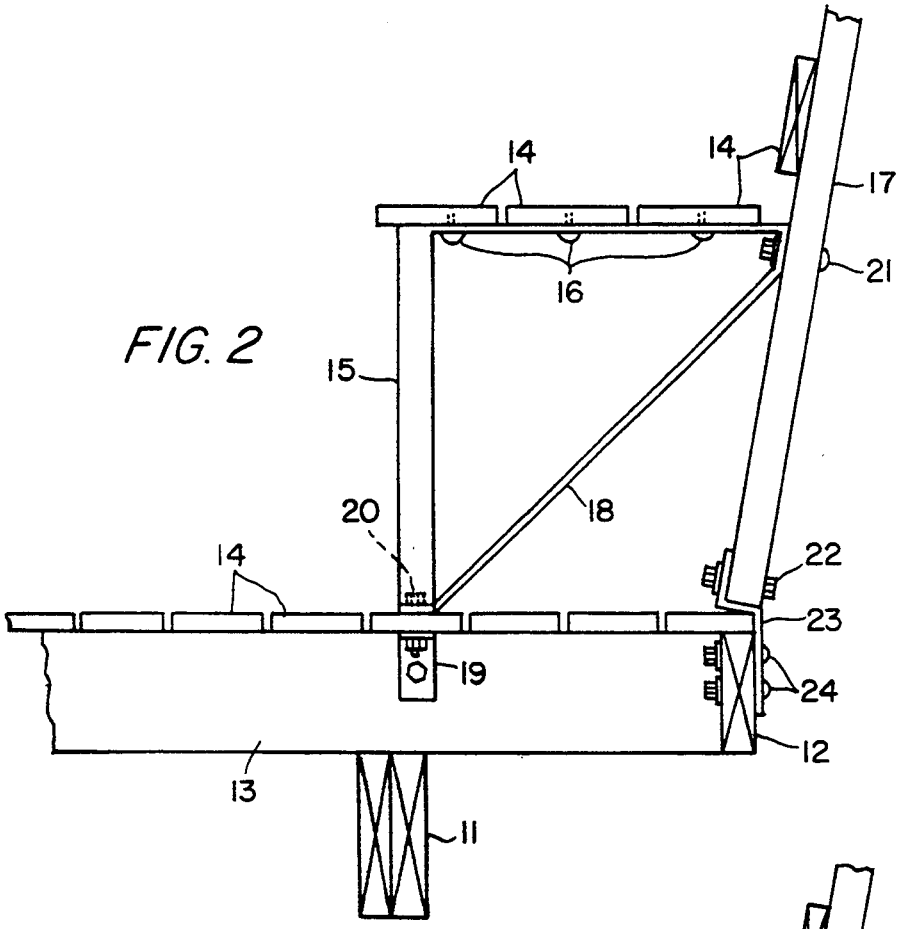
FIG. 2 is a side view of a deck with a bench/railing combination where the deck stringers are normal to the seat.

Referring now to FIG. 2, we see the side view of the invention. The triangular member 15 with its cross member 18 with planks 14 form a seat for someone to use. The railing 17 is at an angle to the deck. It is bolted to member 23, which is bolted to the stringers 12 by means of bolts 24. Note that the angle of member 23 is adjustable in that it can be bent to cause the various risers that form one side to be aligned without having to spend a great deal of time or detract from the safety of the deck. The member 15 is bolted to the stringers by means of the member 19 below the deck which in turn is bolted directly to a stringer. The bolts go through the planks or flooring. The floor boards do not provide sufficient strength to support a railing or a seat/railing.

It is to be noted that the member 15 is bolted in several inches from the edge or perimeter of the deck. This transfers the pulling tension to the stringers below the deck. After years and years of service sufficient strength still remains such that the railing 17 cannot be pushed or torn away from the side of the deck regardless of the force or weight placed upon the seat/railing arrangement.

When the deck is entirely assembled, it presents a minimum of steel and cannot be seen by the owner who stands on the deck and sees the floor and the seat boards 14 that form the railing around the deck.

Deck planks 14 can be nailed to the wooden railing 17 to form the back of the seat. They are not critical as far as strength is concerned. Metal members are pre-drilled to receive bolts. Planks 14 are bolted on to these members to form the bottom of the seat. Along one perimeter several of these rails 17 are placed at preselected intervals depending upon the thickness of the planks which form a seat. Four feet is optimum for 2×6 planks. Thinner planks would require a shorter distance between rails of about three feet.

Figure 3:
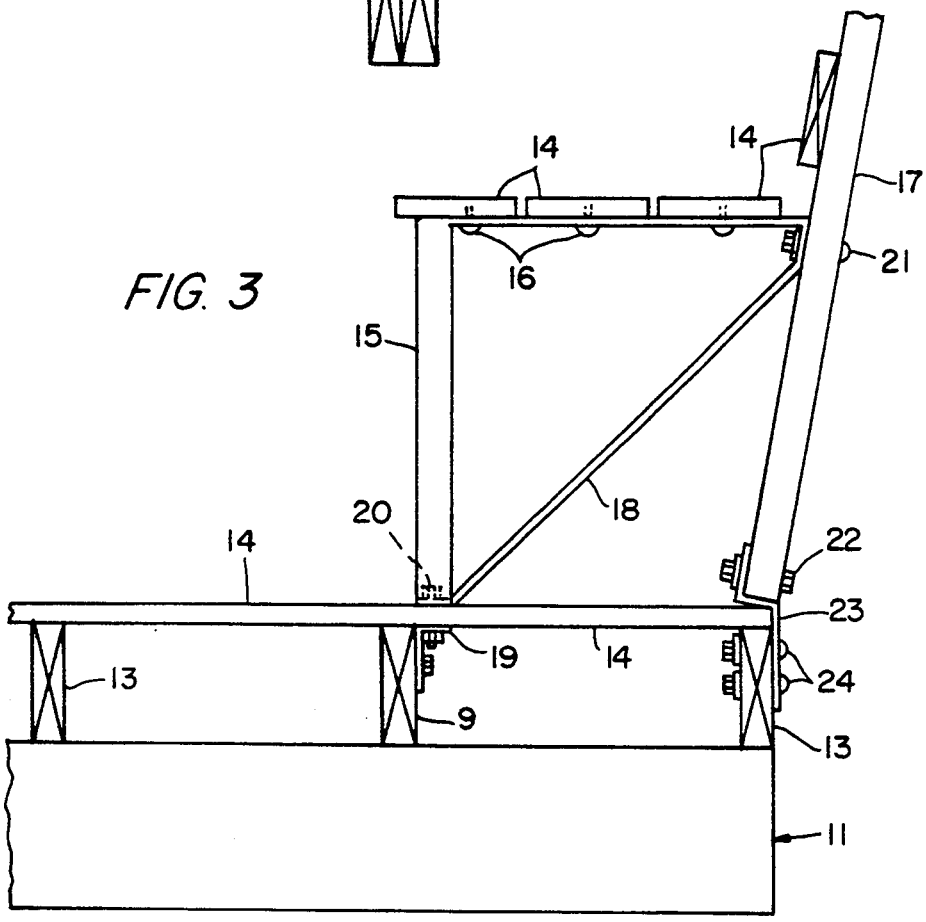
FIG. 3 is a side view of a deck with the same arrangement as FIG. 2 except that the stringers are parallel to the seat.

Referring to FIG. 3, we see the arrangement when the seat/rail is along the side of the deck which is parallel to stringers 13. A stringer 9 must be added approximately 10½ inches in from the edge so that members 19 can be bolted to it for maximum support for members 15. Again it is seen that the triangular member 15 receives the tension from railing 17 when it is pushed out and transfers that tension to the stringer 9 by way of member 19 and bolts 20 and 30.

Other systems merely depend on bolting to the edge of the deck boards 14 and the stringer 13 along the perimeter of the deck. Obviously they will fail under any significant load placed on the railing 17. The present system transfers the tension to the underdeck structure which remains strong throughout the deck's life.

Figure 4:
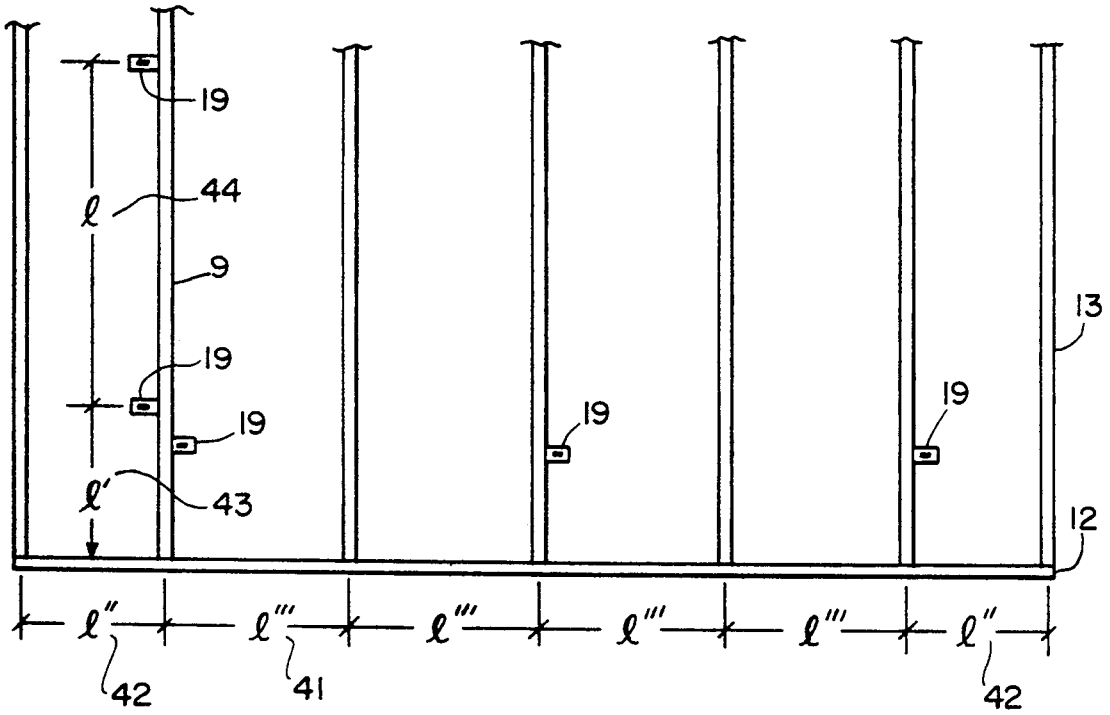
FIG. 4 is a schematic top view of a deck showing the placement of the deck stringers and safety anchors.

Referring to FIG. 4, we see a top view of the stringer arrangement for a given deck. Stringers 13 are laid out parallel to each other 16 inches apart. However, special stringers 9 have been added 10½ inches in from the edge of one side of the deck that is parallel to the stringers to receive members 19. Two of the members 19 are for use when the deck seat/rail is normal to the stringers (i.e., not parallel to them). Adding stringers makes sure that tension is transferred from the railing all around the deck uniformly whether the railings are affixed to a side of the deck that is normal or parallel to the stringers below the deck and insures that the tension is transferred in at least 10½ inches from the edge of the deck all around.

Although I have described my invention with reference to specific embodiments, I do not wish to be limited thereby. I only wish to be limited by the appended claims of which:

I claim:

1. A method of constructing a seat for a wooden deck, said deck comprising a plurality of stringers including outer stringers which form the perimeter of the deck and cross stringers which form the interior frame of the deck, said plurality of stringers together forming the understructure of the deck; and a plurality of planks which together form the floor surface of the deck;

said method comprising:

affixing a plurality of metal anchor brackets to a preselected cross stringer a preselected distance apart, said preselected cross stringer being spaced a preselected distance in from a respective outer stringer;

bolting a plurality of metal side brackets to said respective outer stringer said preselected distance apart, such that said side brackets are aligned with said anchor brackets;

bolting a riser to each side bracket;

providing a plurality of right triangle-shaped metal braces for attachment to said anchor brackets and said risers;

attaching each brace to a respective anchor bracket and a respective riser, such that a first side of each brace is parallel to said planks, a second side of each brace is perpendicular to said planks, and the hypotenuse side of each brace extends between said respective anchor bracket and said respective riser;

attaching deck boards to said first side of each brace to form the seat portion of said seat;

nailing planks along said risers to form the back portion of said seat and a barrier beneath said seat.

* * * * *